US005752499A

United States Patent [19]

Mori et al.

[11] Patent Number: 5,752,499

[45] Date of Patent: May 19, 1998

[54] VARIABLE CAPACITY TYPE VISCOUS HEATER

[75] Inventors: Hidefumi Mori, Aichi-ken; Takashi Ban, Kariya; Kiyoshi Yagi; Kunifumi Goto, both of Aichi-ken, all of Japan

[73] Assignee: Kabushiki Kaisha Toyoda Jidoshokki Seisakusho, Kariya, Japan

[21] Appl. No.: 836,870

[22] PCT Filed: Sep. 5, 1996

[86] PCT No.: PCT/JP96/02527

§ 371 Date: May 6, 1997

§ 102(e) Date: May 6, 1997

[87] PCT Pub. No.: WO97/10112

PCT Pub. Date: Mar. 20, 1997

[30] Foreign Application Priority Data

Sep. 11, 1995 [JP] Japan ..... 7-232697

[51] Int. Cl.[6] ..... F24C 9/00

[52] U.S. Cl. ..... 126/247; 122/26

[58] Field of Search ..... 126/247; 122/26

[56] References Cited

U.S. PATENT DOCUMENTS 4,733,635 3/1988 Menard et al. ..... 122/26

4,974,778 12/1990 Bertling ..... 122/26

4,993,377 2/1991 Itakura ..... 123/142.1 R 5,573,184 11/1996 Martin ..... 122/26

FOREIGN PATENT DOCUMENTS 2246823 10/1990 Japan .

*Primary Examiner*—Carroll B. Dority

*Attorney, Agent, or Firm*—Brooks Haidt Haffner and Delahunty

[57] ABSTRACT

A variable capacity type viscous heater is provided which can carry out the capacity control reliably, and which can inhibit the endurable heat-generating efficiency of a viscous fluid from deteriorating even after a long period of service. For instance, its rear housing 6 is provided with a control chamber 9 which is communicated with a central region of a heat-generating chamber 7, and which has an internal volume capable of expanding and contracting. When a rotor 14 is kept rotated, a silicone oil held, in the heat-generating chamber 7, expands the internal volume of the control chamber 9 by the Weissenberg effect in the capacity reduction. As a result, the heating is relieved, because the silicone oil, held in the heat-generating chamber 7, is collected into the control chamber 9.

9 Claims, 4 Drawing Sheets

VARIABLE CAPACITY TYPE VISCOUS HEATER

DESCRIPTION

1. Technical Field

The present invention relates to a variable capacity type viscous heater in which a viscous fluid is caused to generate heat by shearing. The resulting heat is utilized as a thermal source for heating by carrying out heat exchange with a circulating fluid which circulates in a radiator chamber.

2. Background Art

Conventionally, a variable capacity type viscous heater is disclosed as set forth in Japanese Unexamined Patent Publication (KOKAI) No. 3-98,107. In this viscous heater, a front housing and a rear housing are disposed and fastened so as to face with each other, and form a heat-generating chamber and a water jacket therein. The water jacket is disposed around an outer region of the heat-generating chamber. In the water jacket, circulating water is circulated so that it is taken in through a water inlet port, and that it is delivered out to an external heating circuit through a water outlet port. In the front and rear housings, a driving shaft is held rotatably via a bearing apparatus. To the driving shaft, a rotor is fixed so that it can rotate in the heat-generating chamber. A wall surface of the heat-generating chamber and an outer surface of the rotor constitute axial labyrinth grooves which approach to each other. In a space between the wall surface of the heat-generating chamber and the outer surface of the rotor, a viscous fluid, such as a silicone oil, is interposed.

The characteristic arrangements of the viscous heater are as follows: An upper cover and a lower cover, which are provided with a diaphragm therein, are disposed below the front and rear housings. A control chamber is defined by the upper cover and the diaphragm. The heat-generating chamber is communicated with the atmosphere by a through hole which is drilled through at the upper end of the front and rear housings, and the heat-generating chamber is also communicated with the control chamber by a communication pipe which is formed in the upper cover. The diaphragm is capable of adjusting the internal volume of the control chamber by means of a manifold negative pressure, a coil spring, and the like.

In the viscous heater built into a vehicle heating apparatus, the rotor rotates in the heat-generating chamber when the driving shaft is driven by an engine. Accordingly, the viscous fluid is caused to generate heat by shearing in the space between the wall surface of the heat-generating chamber and the outer surface of the rotor. The thus generated heat is heat-exchanged to the circulating water in the water jacket. The heated circulating water is used at the heating circuit to heat a compartment of a vehicle.

According to the publication, the capacity variation of the viscous heater is effected as follows. For example, when the heating is carried out too strongly, the diaphragm is displaced downward by means of a manifold negative pressure, thereby enlarging the internal volume of the control chamber. Thus, the heat generation is reduced in the space between the wall surface of the heat-generating chamber and the outer surface of the rotor to relieve the heating, because the viscous fluid, held in the heat-generating chamber, is collected into the control chamber. On the contrary, when the heating is carried out too weakly, the diaphragm is displaced upward by an action of an atmospheric pressure adjustment hole and a coil spring, thereby reducing the internal volume of the control chamber. Thus, the heat generation is increased in the space between the wall surface of the heat-generating chamber and the outer surface of the rotor to intensify the heating, because the viscous fluid, held in the control chamber, is delivered out into the heat-generating chamber.

However, in the above-described conventional viscous hater, the viscous fluid should be collected into the control chamber by means of its own weight when reducing the capacity, because the control chamber is disposed below the heat-generating chamber. In this instance, it was found difficult for the viscous fluid to move downward when the rotor is kept rotated. In particular, in the viscous heater, it is further difficult for the viscous fluid to move downward, because the wall surface of the heat-generating chamber and the outer surface of the rotor constitute the axial labyrinth grooves which approach to each other. Therefore, in the viscous heater, the capacity is less likely to be reduced when the heating is carried out too strongly, or when the heating is not needed.

Moreover, in the viscous heater, the viscous fluid is collected into the control chamber from the heat-generating chamber, and thereby a negative pressure arises in the heat-generating chamber. The resulting negative pressure is canceled by introducing fresh air via the through hole. Consequently, the viscous fluid contacts with the fresh air every time the capacity is reduced, and is replenished with the water, which is held in the air, at any time. As a result, the degradation by the water is likely to develop in the viscous fluid. In this instance, the endurable heat-generating efficiency of the viscous fluid is deteriorated inevitably after a long period of service.

It is therefore an assignment to the present invention to provide a variable capacity type viscous heater in which the capacity reduction is carried out securely, and which can inhibit a viscous fluid from deteriorating the endurable heat-generating efficiency even after a long period of service.

SUMMARY OF THE INVENTION

A variable capacity type viscous heater set forth in claim 1 comprises:

a front housing and a rear housing in which a heat-generating chamber is formed;

a radiator chamber formed in one of the front and rear housings at least, neighboring the heat-generating chamber, and circulating a circulating fluid therein;

a driving shaft held rotatably to the front housing by way of a bearing apparatus;

a rotor disposed in the heat-generating chamber rotatably by the driving shaft; and a viscous fluid interposed in a space between a wall surface of the heat-generating chamber and an outer surface of the rotor, and caused to generate heat by the rotating rotor;

wherein a control chamber is disposed in the rear housing, the control chamber communicated with a central region of the heat-generating chamber and having an internal volume capable of expanding and contracting, and the internal volume of the control chamber is enlarged at least by the Weissenberg effect of the viscous fluid in the capacity reduction.

In the variable capacity type viscous heater set forth in claim 1, the control chamber is disposed in the rear housing. The control chamber is communicated with a central region of the heat-generating chamber, and has an internal volume capable of expanding and contracting. The viscous fluid, held in the heat-generating chamber, enlarges the internal volume of the control chamber in the capacity reduction by the Weissenberg effect. The Weissenberg effect herein means that, when the rotor is kept rotated, the viscous fluid is rotated perpendicularly with respect to the liquid surface and is gathered around the axial center against the centrifugal force. It is believed that the Weissenberg effect results from the normal stress effect. As a result, the heat generation is reduced in the space between the wall surface of the heat-generating chamber and the outer surface of the rotor to relieve the heating, because the viscous fluid, held in the heat-generating chamber, is collected into the control chamber.

Note that, in the variable capacity type viscous heater, the air, which has been inevitable during the assembly operation, resides more or less in the space between the wall surface of the heat-generating chamber and the outer surface of the rotor, in addition to the viscous fluid interposed in the space. The air, which has originally resided in the heat-generating chamber, is expanded thermally when the viscous fluid is collected from the heat-generating chamber to the control chamber due to the excessively strong heating. The expanded air cancels the negative pressure resulting from the viscous fluid which is transferred from the heat-generating chamber to the control chamber. Accordingly, the viscous fluid is less likely to deteriorate, because it does not contact with the newly introduced air, and because it is not replenished with the water, which is held in the air, at any time.

A variable capacity type viscous heater set forth in claim 2 is characterized in that the heat-generating chamber of the viscous heater set forth in claim 1 is formed flat on the front and rear wall surfaces, and that the rotor thereof is formed as a flat plate shape.

In the variable capacity type viscous heater set forth in claim 2, the heat-generating chamber is formed flat on the front and rear wall surfaces, and the rotor is formed as a flat plate shape. When the heat-generating chamber and the rotor have such configurations, the viscous fluid exhibits the liquid surface of a large area perpendicularly with respect to the axial center. Consequently, the aforementioned Weissenberg effect arises securely.

A variable capacity type viscous heater set forth in claim 3 is characterized in that the control chamber of the viscous heater set forth in claim 1 or 2 is provided with and defined by a diaphragm, and that the diaphragm is at least capable of reducing the internal volume of the control chamber by an external input.

In the variable capacity type viscous heater set forth in claim 3, the diaphragm is displaced by the external input to reduce the internal volume of the control chamber when the heating is carried out too weakly. As a result, the heat generation is increased in the space between the wall surface of the heat-generating chamber and the outer surface of the rotor to intensify the heating, because the viscous fluid, held in the control chamber, is delivered out into the heat-generating chamber.

A variable capacity type viscous heater set forth in claim 4 is characterized in that the rear housing, forming the rear radiator chamber, of the variable capacity type viscous heater set forth in claim 3 includes a rear plate, and a rear housing body constituting the rest of the rear housing, the rear plate forming a rear wall surface of the heat-generating chamber with a front end surface thereof and a front wall surface of the rear radiator chamber with a rear end surface thereof; and that the rear plate, the rear housing body and the front housing are overlapped and fastened by a through bolt with a gasket interposed between the rear plate and the rear housing body, the gasket being integrally provided with a diaphragm.

In the variable capacity type viscous heater set forth in claim 4, the rear housing is constituted by the rear plate and the rear housing body. The rear plate, the rear housing body and the front housing are overlapped and fastened by a through bolt. The rear radiator chamber is formed by the rear plate and the rear housing body. A circulating fluid, circulating in the rear radiator chamber, little leaks to the outside, because the gasket is interposed between the rear plate and the rear housing body. Moreover, the gasket is integrally provided with the diaphragm. As a result, the construction of the viscous heater can be simplified, because it is not needed to dispose the diaphragm independently, and because it is not required to provide means for inhibiting the diaphragm from coming off.

A variable capacity type viscous heater set forth in claim 5 is characterized in that the control chamber of the viscous heater set forth in claim 1 or 2 is provided with and defined by a bellows, and that the bellows is at least capable of reducing the internal volume of the control chamber by an external input.

In the variable capacity type viscous heater set forth in claim 5, the bellows is displaced by the external input to reduce the internal volume of the control chamber when the heating is carried out too weakly. As a result, the heat generation is increased in the space between the wall surface of the heat-generating chamber and the outer surface of the rotor to intensify the heating, because the viscous fluid held in the control chamber is delivered out into the heat-generating chamber.

A variable capacity type viscous heater set forth in claim 6 is characterized in that the rear housing, forming the rear radiator chamber, of the variable capacity type viscous heater set forth in claim 5 includes a rear plate, and a rear housing body constituting the rest of the rear housing, the rear plate forming a rear wall surface of the heat-generating chamber with a front end surface thereof and a front wall surface of the rear radiator chamber with a rear end surface thereof; and that the rear plate, the rear housing body and the front housing are overlapped and fastened by a through bolt with a gasket interposed between the rear plate and the rear housing body, the gasket being integrally provided with a bellows.

In the variable capacity type viscous heater set forth in claim 6, the rear housing is constituted by the rear plate and the rear housing body. The rear plate, the rear housing body and the front housing are overlapped and fastened by a through bolt. The rear radiator chamber is formed by the rear plate and the rear housing body. A circulating fluid, circulating in the rear radiator chamber, little leaks to the outside, because the gasket is interposed between the rear plate and the rear housing body. Moreover, the gasket is integrally provided with the bellows. As a result, the construction of the viscous heater can be simplified, because it is not needed to dispose the bellows independently, and because it is not required to provide means for inhibiting the bellows from coming off.

A variable capacity type viscous heater set forth in claim 7 is characterized in that the control chamber of the viscous heater set forth in claim 1 or 2 is provided with and defined by a spool, and that the spool is capable of adjusting the internal volume of the control chamber by a solenoid which is excited by an external signal.

In the variable capacity type viscous heater set forth in claim 7, the internal volume of the control chamber is enlarged by exciting the solenoid in accordance with an external signal when the heating is carried out too strongly. As a result, the heat generation is decreased in the space between the wall surface of the heat-generating chamber and the outer surface of the rotor to relieve the heating, because the viscous fluid, held in the control chamber, is collected into the control chamber by the Weissenberg effect.

On the contrary, in the variable capacity type viscous heater set forth in claim 7, the internal volume of the control chamber is reduced by demagnetizing the solenoid in accordance with an external signal when the heating is carried out too weakly. As a result, the heat generation is increased in the space between the wall surface of the heat-generating chamber and the outer surface of the rotor to intensify the heating, because the viscous fluid, held in the control chamber, is delivered out into the heat-generating chamber. Note that it is possible to reduce the internal volume of the control chamber by exciting the solenoid, and that it is possible to enlarge the internal volume of the control chamber by demagnetizing the solenoid.

A variable capacity viscous heater set forth in claim 8 is characterized in that the control chamber of the viscous heater set forth in claim 1 or 2 is provided with and defined by a spool, and that the spool is capable of adjusting the internal volume of the control chamber by a thermoactuator.

In the variable capacity type viscous heater set forth in claim 8, the internal volume of the control chamber is enlarged by displacing the spool with the thermoactuator in accordance with a detector unit temperature when the heating is carried out too strongly. As a result, the heat generation is decreased in the space between the wall surface of the heat-generating chamber and the outer surface of the rotor to relieve the heating, because the viscous fluid, held in the control chamber, is collected into the control chamber by the Weissenberg effect.

On the contrary, in the variable capacity type viscous heater set forth in claim 8, the internal volume of the control chamber is reduced by displacing the spool with the thermoactuator in accordance with a detector unit temperature when the heating is carried out too weakly. As a result, the heat generation is increased in the space between the wall surface of the heat-generating chamber and the outer surface of the rotor to intensify the heating, because the viscous fluid, held in the control chamber, is delivered out into the heat-generating chamber.

A variable capacity type viscous heater set forth in claim 9 is characterized in that a through hole is drilled longitudinally through a central region in the rotor of the variable capacity type viscous heater set forth in claim 1 or 2.

In the variable capacity type viscous heater set forth in claim 9, the viscous fluid, held between a front wall surface of the heat-generating chamber and a forward side surface of the rotor, is likely to be collected into the control chamber in the rear housing by way of the through hole when the capacity is reduced, because the through hole is drilled longitudinally through a central region in the rotor. On the contrary, the viscous fluid, held in the control chamber, is likely to be delivered out between the front wall surface of the heat-generating chamber and the forward side surface of the rotor when the capacity is enlarged.

As having described so far, the variable capacity type viscous heater set forth in the appended claims can produce the following advantages by employing the means recited in the claims.

The variable capacity type viscous heater set forth in claims 1 through 9 can carry out the capacity reduction securely, and can inhibit the endurable heat-generating efficiency of the viscous fluid from deteriorating even after a long period of service. Thus, the variable capacity type viscous heater does not necessarily require an electromagnetic clutch when the heating is required, or when it is not required, because it is capable of reliably carrying out the capacity control. As a result, the variable capacity type viscous heater can realize the cost reduction in heating apparatuses and the weight reduction therein.

In particular, the variable capacity type viscous heater set forth in claims 4 and 6 can realize the manufacturing cost reduction, because the construction is simplified.

Moreover, the variable capacity type viscous heater set forth in claim 9 can carry out the capacity control further reliably, because the viscous fluid is readily transferred by means of the through hole.

BEST MODE FOR CARRYING OUT THE INVENTION

First through Fourth Preferred Embodiments embodying the present invention set forth in the appended claims will be hereinafter described with reference to the drawings.

(First Preferred Embodiment)

The variable capacity type viscous heater of the First Preferred Embodiment embodies claims 1 through 4, and 9.

Figure 1:
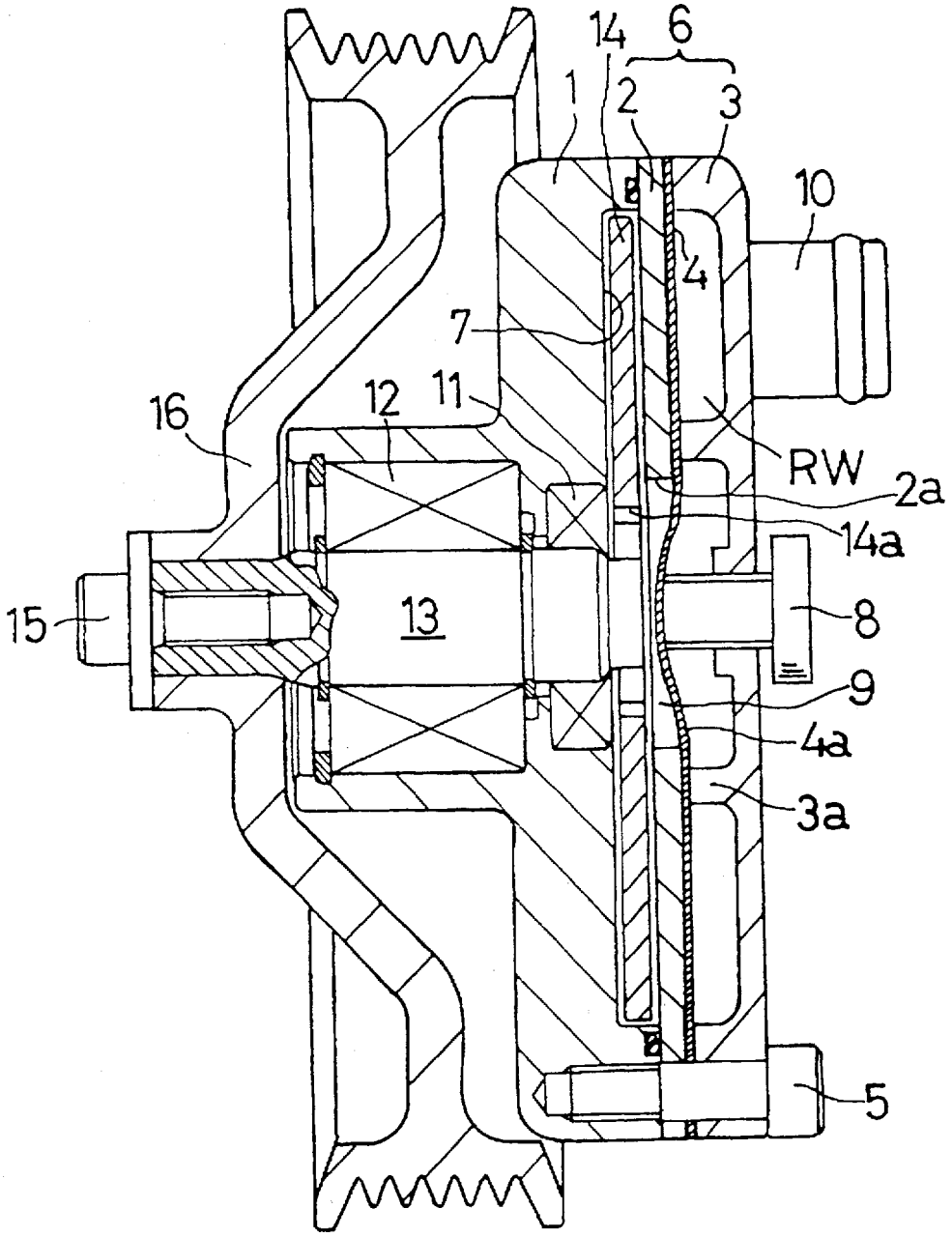
FIG. 1 is a vertical cross-sectional view of a variable capacity type viscous heater of a First Preferred Embodiment.

As illustrated in FIG. 1, in the viscous heater, a front housing 1, a rear plate 2 and a rear housing body 3 are overlapped and fastened by a plurality of through bolts 5 with a gasket 4 interposed between the rear plate 2 and the rear housing body 3. Here, the rear plate 2 and the rear housing body 3 constitute a rear housing 6.

The rear plate 2 is formed as an annular shape which has a central aperture 2*a* in the cental region thereof. In a rear-end surface of the front housing 1, a concavity is dented flatly, and forms a heat-generating chamber 7 together with a flat front-end surface of the rear plate 2. Further, on an inner central region of the rear housing body 3, an annular-shaped rib 3*a* is protruded in an axial direction. Furthermore, a rear-end surface of the rear plate 2 and an outside inner surface of the rear housing body 3 form a rear water jacket RW. The rear water jacket RW works as the rear radiator chamber neighboring the heat-generating chamber 7. Thus, circulating water, working as the circulating fluid and being circulated in the rear radiator chamber RW, hardly leaks to the outside, because the gasket 4 is interposed between the rear plate 2 and the rear housing body 3. Moreover, the gasket 4 is provided integrally with a diaphragm 4*a* so that it covers the central aperture 2*a* of the rear plate 2. In addition, an adjusting screw 8 is disposed at the center of the rear housing body 3 so that it can contact with a rear surface of the diaphragm 4*a*. Accordingly, a control chamber 9 is formed in front of the diaphragm 4*a*. Note that the control chamber 9 is communicated with a central region of the heat-generating chamber 7, and that it has an internal volume capable of expanding and contracting. Hence, in the viscous heater, a diaphragm should not be disposed independently, and means for inhibiting a diaphragm from coming off should not be provided, because the gasket 4 is provided integrally with the diaphragm 4*a*.

Moreover, in an outer region on a rear surface of the rear housing body 3, a water inlet port 10 and a water outlet port (not shown) are formed. The water inlet port 10 takes in the circulating water from an external heating circuit (not shown). The water outlet port delivers the circulating water out to the heating circuit. The water inlet port 10 and the water outlet port are communicated with the rear water jacket RW.

In addition, a shaft-sealing apparatus 11, and a bearing apparatus 12 are disposed so as to neighbor the heat-generating chamber 7 in the front housing 1. By way of the shaft-sealing apparatus 11 and the bearing apparatus 12, a driving shaft 13 is held rotatably. At the trailing end of the driving shaft 13, a plate-shaped rotor 14 is press-fitted so that it can rotate in the heat-generating chamber 7. A silicone oil is interposed in the space between the wall surface of the heat-generating chamber 7 and the outer surface of the rotor 14. The silicone oil works as the viscous fluid. In a central region of the rotor 14, a plurality of communication holes 14*a* are drilled through longitudinally. At the leading end of the driving shaft 13, a pulley 16 is fixed by a bolt 15. The pulley 16 is rotated by a vehicle engine via a belt.

In the viscous heater built-into a vehicle heating apparatus, the rotor 14 is rotated in the heat-generating chamber 7 when the driving shaft 13 is driven by the engine by way of the pulley 16. Accordingly, the silicone oil is sheared in the space between the wall surface of the heat-generating chamber 7 and the outer surface of the rotor 14, thereby generating heat. The resulting heat is heat-exchanged to the circulating water flowing in the rear water jacket RW, and the thus heated circulating water is used for heating a compartment of a vehicle with the heating circuit.

In the mean time, when the rotor 14 is kept rotated, and when the heating is carried out too strongly, the silicone oil, held in the heat-generating chamber 7, displaces the diaphragm 4*a* rearwardly by the Weissenberg effect, thereby expanding the internal volume of the control chamber 9. The Weissenberg effect arises securely, because the heat-generating chamber 7 is formed flat on the front and rear wall surfaces, and because the rotor 14 is formed as a flat plate shape. The internal volume of the control chamber 9 is expanded until the rear surface of the diaphragm 4*a* is brought into contact with the leading end of the adjusting screw 8. As a result, the heat generation is reduced in the space between the wall surface of the heat-generating chamber 7 and the outer surface of the rotor 14 to relieve the heating, because the silicone oil, held in the heat-generating chamber 7, is collected into the control chamber 9. Note that, in the capacity reduction, the silicone oil, held between the front wall surface of the heat-generating chamber 7 and the forward side surface of the rotor 14, is likely to be collected into the control chamber 9 through the communication holes 14*a*.

On the other hand, when the heating is carried out too weakly, the adjusting screw 8 is screwed in by a predetermined length so as to displace the diaphragm 4*a* forwardly, thereby contracting the internal volume of the control chamber 9 as shown in FIG. 1. As a result, the heat generation is increased in the space between the wall surface of the heat-generating chamber 7 and the outer surface of the rotor 14 to intensify the heating, because the silicone oil, held in the control chamber 9, is delivered out into the heat-generating chamber 7. Note that, in the capacity enlargement as well, the silicone oil is likely to be delivered out between the front wall surface of the heat-generating chamber 7 and the forward side surface of the rotor 14.

In the viscous heater, not only the viscous fluid is interposed in the space between the wall surface of the heat-generating chamber 7 and the outer surface of the rotor 14, but also the inevitable air resides more or less in the space. Note that the inevitable air results from the assembly operation of the viscous heater. When the silicone oil is collected from the heat-generating chamber 7 into the control chamber 9 due to the excessively strong heating, the air, which has originally resided in the heat-generating chamber 7, is expanded thermally. The expanded air cancels the negative pressure which results from the silicone oil being transferred from the heat-generating chamber 7 into the control chamber 9. Accordingly, the silicone oil is less likely to deteriorate, because it does not contact with the newly introduced air, and because it is not replenished with the water, which is held in the air, at any time.

Therefore, in the viscous heater, the capacity control can be carried out reliably, and the endurable heat-generating efficiency of the silicone oil can be inhibited from deteriorating even after a long period of service.

Moreover, in the viscous heater, the reduction of the manufacturing cost can be realized, because the construction of the viscous heater is simplified.

Note that, instead of the pulley 16, an electromagnetic clutch can be employed to intermittently drive the driving shaft 13. Further, the heat-exchange can be carried out fully by providing a front water jacket which is communicated with the rear water jacket RW. Furthermore, the heat-exchange can be carried out furthermore fully by providing a fin, or the like, with the rear water jacket RW, etc. The gasket 4, which is provided integrally with the diaphragm 4*a*, can be disposed at an inner region with respect to the rib 3*a* at least. The other gasket, for example, an O-ring, or the like, can be employed in the outer peripheries of the rear plate 2 and the rear housing body 3.

(Second Preferred Embodiment)

The variable capacity type viscous heater of the Second Preferred Embodiment embodies claims 1, 2, 5, 6, and 9.

Figure 2:
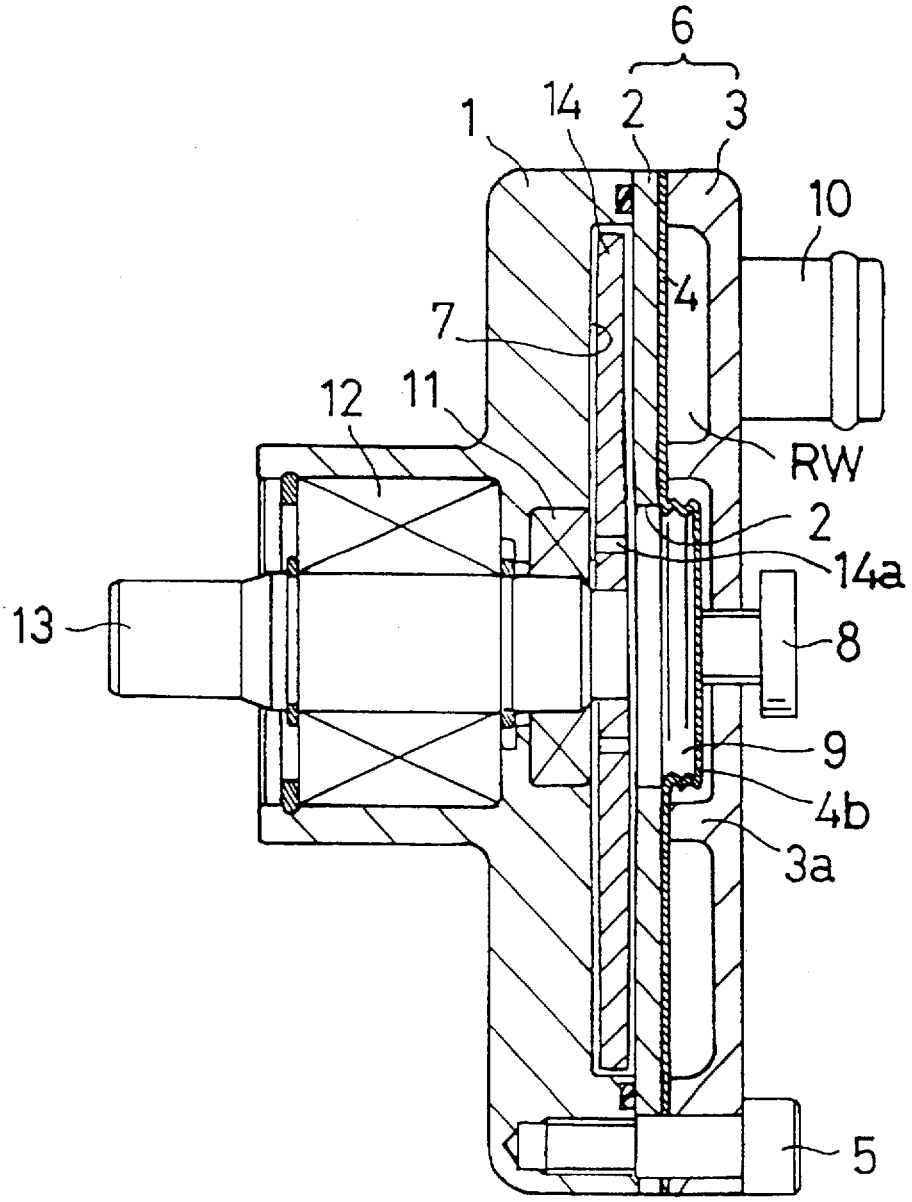
FIG. 2 is a vertical cross-sectional view of a variable capacity type viscous heater of a Second Preferred Embodiment.

As illustrated in FIG. 2, in the viscous heater, a bellows 4*b* is employed instead of a diaphragm. Unless otherwise specified, the Second Preferred Embodiment has the same arrangements as those the First Preferred Embodiment.

The viscous heater of the Second Preferred Embodiment can operate and produce advantages in the same manner as the First Preferred Embodiment. Note that the gasket 4, which is provided integrally with the bellows 4*b*, can be disposed at an inner region with respect to the rib 3*a* at least. Also note that the other gasket, for example, an O-ring, or the like, can be employed in the outer peripheries of the rear plate 2 and the rear housing body 3.

(Third Preferred Embodiment)

The variable capacity type viscous heater of the Third Preferred Embodiment embodies claims 1, 2, 7, and 9.

Figure 3:
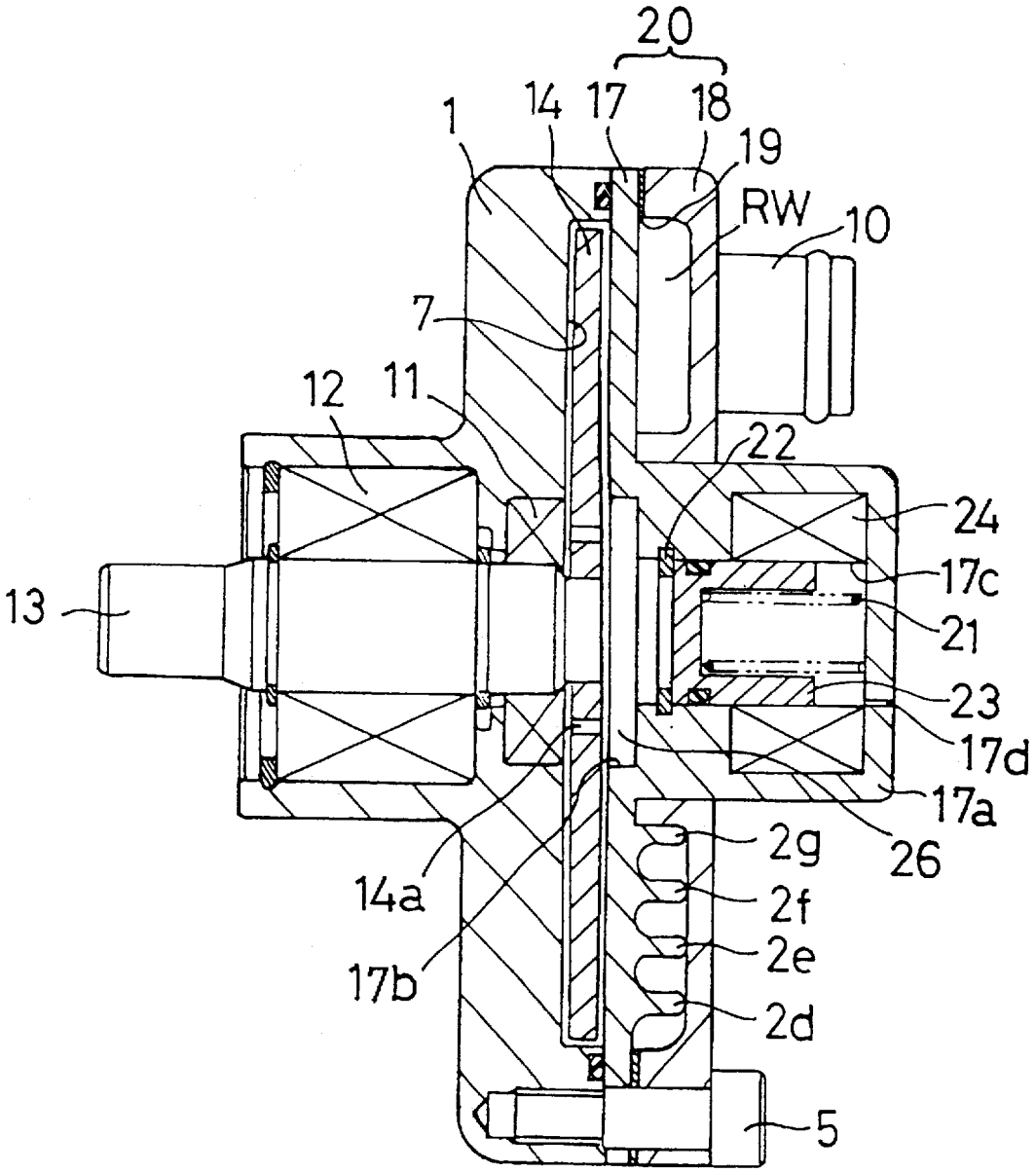
FIG. 3 is a vertical cross-sectional view of a variable capacity type viscous heater of a Third Preferred Embodiment.

As illustrated in FIG. 3, in the viscous heater, a front housing 1, a rear plate 17 and a rear housing body 18 are overlapped and fastened by a plurality of through bolts 5 with a gasket 19 interposed between the rear plate 17 and the rear housing body 18. Here, the rear plate 17 and the rear housing body 18 constitute a rear housing 20.

The rear plate 17 is provided integrally with a case 17*a* at a central region thereof. The case 17*a* is protruded rearwardly. Further, at a central region of a rear-end surface of the rear plate 17, a first concavity 17*b* is dented. Furthermore, in the first concavity 17*b*, a second concavity 17*c* is dented. The second concavity 17*c* extends within the case 17*a*. Moreover, at predetermined portions in an outer peripheral region of a rear-end surface of the rear plate 17, four streaks of fins 2*d* through 2*g* are protruded in an axial direction. The fins 2*d* through 2*g* extend like an arc around the case 17*a* from the vicinity of a water inlet port 10 to the vicinity of a water outlet port. In addition, the rear housing body 18 is formed as an annular shape. An outer peripheral region of a rear-end surface of the rear plate 17 and an inner surface of the rear housing body 18 form a rear water jacket RW. The rear water jacket RW works as the rear radiator chamber neighboring the heat-generating chamber 7.

In the second concavity 17*c* of the case 17*a*, a spool 23 is slidably accommodated. The spool 23 is urged forwardly by a pressing spring 21, and is formed of an iron-based material. Note that a snap ring 22 regulates the advance end of the spool 23. At the rear end of the second concavity 17*c*, a solenoid 24 is disposed. Thus, in front of the spool 23, a control chamber 26 is defined by the first and second concavities 17*b* and 17*c*. The control chamber 26 is communicated with a central region of the heat-generating chamber 7. The solenoid 24 is excited and demagnetized by a passenger who turns on and off a control switch. In the case 17*a*, a through hole 17*d* is drilled through. Accordingly, the second concavity 17*c* is communicated with the atmosphere by the through hole 17*d*. Unless otherwise specified, the Third Preferred Embodiment has the same arrangements as those of the First and Second Preferred Embodiments.

In the viscous heater, the heating is effected at the maximum capacity at the initial stage of operation when a passenger turns off the control switch to demagnetize the solenoid 24. Specifically, the internal volume of the control chamber 26 is reduced at the initial stage of actuation, because the pressing spring 21 advances the spool 23. As a result, the silicone oil, held in the control chamber 26, is delivered out into the heat-generating chamber 7 so that the heating can be carried out at the maximum capacity.

When the heating is carried out too strongly, or when the capacity control is desired, a passenger turns on the control switch to excite the solenoid 24. At this moment, in addition to the Weissenberg effect, the spool 23 is moved to the retract end against the pressing spring 21 by the solenoid 24. Consequently, the internal volume of the control chamber 26 is enlarged. The silicone oil, held in the heat-generating chamber 7, is collected into the enlarged control chamber 26 by the Weissenberg effect and the solenoid 24, thereby relieving the heating. Note the pressure fluctuation in the second concavity 17*c*, which results from the movement of the spool 23, is canceled, because the through hole 17*d* is opened to the atmosphere.

On the other hand, when the heating is carried out too weakly, or when the capacity control is not desired, a passenger turns off the control switch to demagnetize the solenoid 24. At this moment, the spool 23 yields to the pressing spring 21, and moves to the advance end. Accordingly, the internal volume of the control chamber 26 is reduced. As a result, the silicone oil, held in the control chamber 26, is delivered out into the heat-generating chamber 7, and thereby the heating is carried out at the maximum capacity.

In addition, the heat-exchange can be carried out further fully by the fins 2*d* through 2*g* which are disposed in the rear water jacket RW. Unless otherwise specified, the Third Preferred Embodiment can operate and produce advantages in the same manner as the First and Second Preferred Embodiments.

Likewise, in the thus constructed viscous heater, the capacity control can be carried out reliably, and the endurable heat-generating efficiency of the silicone oil can be inhibited from deteriorating even after a long period of service.

Note that an operator turns on and off the control switch inversely to the aforementioned manner when no pressure spring 21 is provided, and when the solenoid 24 is positioned at the center of the second concavity 17*c*. For instance, when the heating is needed, or when the heating is carried out too weakly, a passenger turns on the control switch to excite the solenoid 24. The spool 23 is moved to reduce the internal volume of the control chamber 26. Consequently, the heating is effected at the maximum capacity. On the contrary, when the heating is carried out too strongly, a passenger turns off the control switch to demagnetize the solenoid 24. The spool 23 is retracted by the Weissenberg effect to enlarge the internal volume of the control chamber 26. Accordingly, the heating is relieved.

Moreover, the internal volume of the control chamber 26 can be determined stepwise by a spool which is actuated by a plurality of solenoids, and the solenoids can be arranged so that they are controlled by external signals.

In addition, the following signals can be employed as the external signal: an output signal produced by a water-temperature sensor for detecting a temperature of the circulating water, flowing in the rear water jacket RW, as well as a temperature of the engine-cooling water; an output signal produced by a passenger-room-temperature sensor for detecting a temperature in a passenger room; and an output signal produced by a sensor for detecting a temperature of the silicone oil.

(Fourth Preferred Embodiment)

The variable capacity type viscous heater of the Fourth Preferred Embodiment embodies claims 1, 2, 8 and 9.

Figure 4:
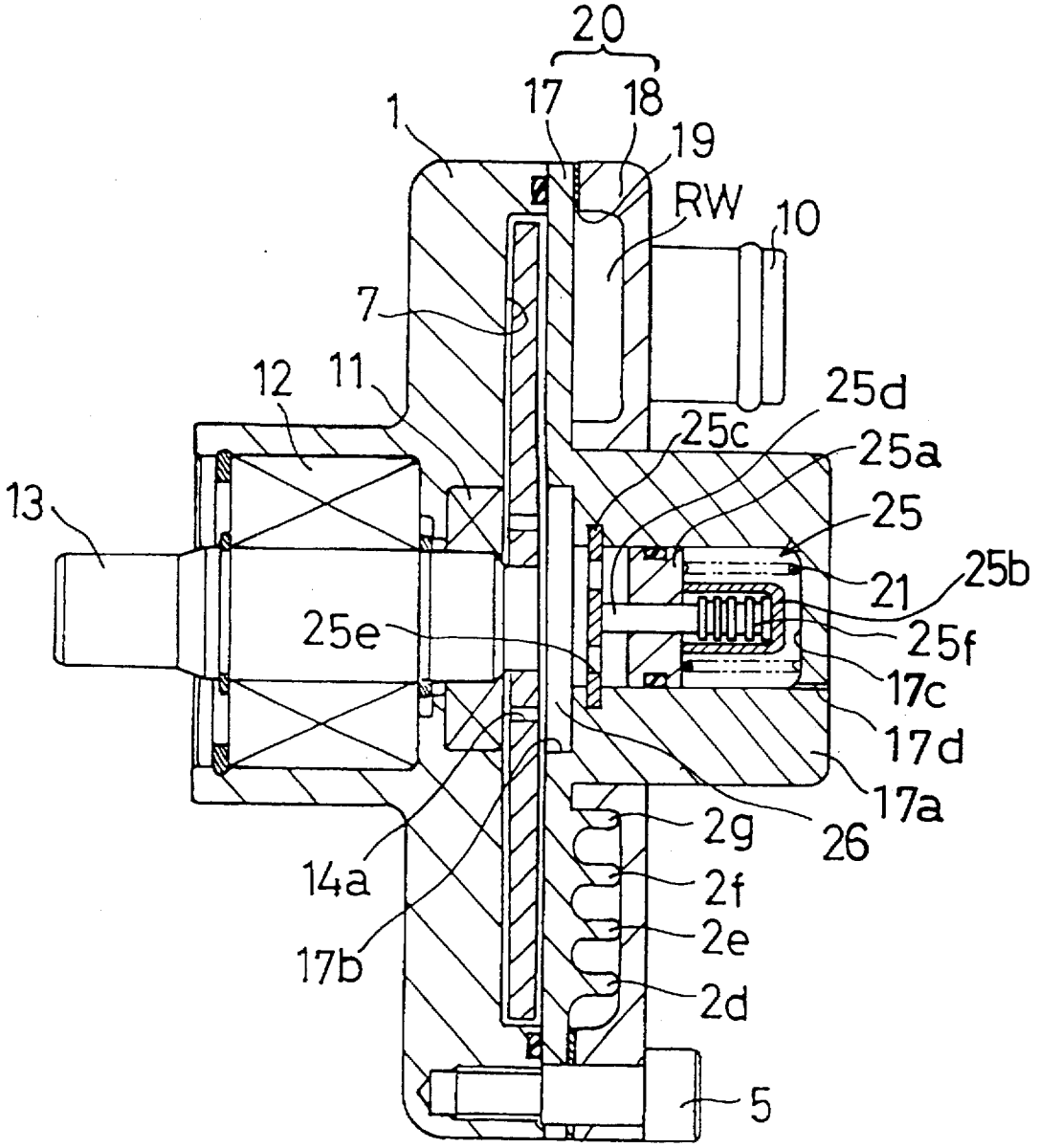
FIG. 4 is a vertical cross-sectional view of a variable capacity type viscous heater of a Fourth Preferred Embodiment.

As illustrated in FIG. 4, the viscous heater differs from that of the Third Preferred Embodiment in that a thermoactuator 25 is employed. Note that the thermoactuator 25 is provided integrally with a spool 25*a*.

Specifically, the thermoactuator 25 comprises a cylinder member 25*b* mounted on the spool 25*a* which is sidably positioned in the second concavity 17*c*, a bellows 25*f* disposed within and fixed to the cylinder member 25*b*, and a rod 25*d* fixed to the top of the bellows 25*f*. Hence, wax, working as a temperature sensor, is accommodated in the bellows 25*f*, and thereby the rod 25*d* is moved in longitudinal direction by extending and contracting the bellows 25*f* in accordance with the change of temperature. Furthermore, a flange 25*c* having a plurality of through holes 25*e* is fixed at the front end of the second concavity 17*c*, and the end of the rod 25*d* is fixed on the flange 25*c*. Thus, in front of the spool 25*a*, there is formed a control chamber 26 which is communicated with a central region of a heat-generating chamber 7. In addition, in the case 17, there is formed a through hole 17*d* which communicates the second concavity 25*c* with the atmosphere. Unless otherwise specified, the Fourth Preferred Embodiment has the same arrangements as those of the Third Preferred Embodiment.

In the viscous heater, when the temperature in the second concavity 17*c*, which depends on the heat transferred from the heat-generating chamber 7, is lower than a predetermined setting temperature, the cylinder member 25*b* detects the temperature to contract the rod 25*d*. Note that the cylinder member 25*b* works as the detector unit. Consequently, the spool 25*a* is displaced forwardly, thereby reducing the internal volume of the control chamber 26. As a result, the heating is intensified, because the silicone oil, held in the control chamber 26, is delivered out into the heat-generating chamber 7. The movement of the spool 25*a* results in the pressure fluctuation in the second concavity 17*c*. However, note that the pressure fluctuation is canceled, because the through hole 17*d* is opened to the atmosphere.

On the other hand, when the temperature in the second concavity 17*c* is higher than a predetermined setting temperature, the rod 25*d* is extended. Consequently, the Weissenberg effect of the silicone oil also helps the spool 25*a* displace rearwardly to enlarge the internal volume of the control chamber 26. As a result, the heating is relieved, because the silicone oil, held in the heat-generating chamber 7, is collected into the control chamber 26.

Hence, the thus constructed viscous heater can produce the same advantages as those produced by the First through Third Preferred Embodiments without ever requiring an external input.

Note that the spool 25*a* can be displaced in accordance with the temperature variation in the second concavity 17*c* which is effected by the following means: introducing the circulating water, flowing in the rear water jacket RW, as well as the engine-cooling water into the second concavity 17*c*; introducing a passenger-room air into the second concavity 17*c*; and introducing the silicone oil, held in the heat-generating chamber 7, into the second concavity 17*c*.

We claim:

1. A variable capacity type viscous heater, comprising:

a housing in which a heat-generating chamber is formed;

a radiator chamber formed in said housing at least, neighboring said heat-generating chamber, and circulating a circulating fluid therein;

a driving shaft held rotatably to said housing;

a rotor disposed in said heat-generating chamber rotatably by said driving shaft; and a viscous fluid interposed in a space between a wall surface of said heat-generating chamber and an outer surface of said rotor, and caused to generate heat by rotation of said rotor; and means forming a control chamber in said housing, said control chamber being communicated with a central region of said heat-generating chamber and having an internal volume capable of expanding and contracting, whereby the internal volume of said control chamber is enlarged at least by the Weissenberg effect of said viscous fluid in the capacity reduction phase.

2. A variable capacity type viscous heater according to claim 1, wherein said heat-generating chamber is formed flat on the front and rear wall surfaces, and said rotor is formed as a flat plate shape.

3. A variable capacity type viscous heater according to claim 1 or 2, wherein said control chamber is provided with and defined by a diaphragm, and the diaphragm is at least capable of reducing the internal volume of said control chamber by an external input.

4. A variable capacity type viscous heater according to claim 3, wherein said housing comprises front and rear housings, said rear housing including a rear plate and a rear housing body which define said radiator chamber, said rear plate forming a rear wall surface of said heat-generating chamber with a front end surface thereof and a front wall surface of said rear radiator chamber with a rear end surface thereof; and said rear plate, said rear housing body and said front housing are overlapped and fastened by a through bolt with a gasket interposed between said rear plate and said rear housing body, the gasket being integrally provided with a diaphragm.

5. A variable capacity type viscous heater according to claim 1 or 2, wherein said control chamber is provided with and defined by a bellows, and the bellows is at least capable of reducing said internal volume of said control chamber by an external input.

6. A variable capacity type viscous heater according to claim 5, wherein said housing comprises front and rear housings, said rear housing including a rear plate and a rear housing body which define said radiator chamber, said rear plate forming a rear wall surface of said heat-generating chamber with a front end surface thereof and a front wall surface of said rear radiator chamber with a rear end surface thereof; and said rear plate, said rear housing body and said front housing are overlapped and fastened by a through bolt with a gasket interposed between said rear plate and said rear housing body, the gasket being integrally provided with a bellows.

7. A variable capacity type viscous heater according to claim 1 or 2, wherein said control chamber is provided with and defined by a spool, and the spool is capable of adjusting said internal volume of said control chamber by a solenoid which is excited by an external signal.

8. A variable capacity type viscous heater according to claim 1 or 2, wherein said control chamber is provided with and defined by a spool, and the spool is capable of adjusting said internal volume of said control chamber by a thermo-actuator.

9. A variable capacity type viscous heater according to claim 1 or 2, wherein a through hole is drilled longitudinally through a central region in said rotor.

* * * * *

UNITED STATES PATENT AND TRADEMARK OFFICE

CERTIFICATE OF CORRECTION

PATENT NO. : 5,752,499
DATED : May 19, 1998
INVENTOR(S) : Hidefumi MORI, Takashi BAN, Kiyoshi YAGI and Kunifumi GOTO It is certified that error appears in the above-identified patent and that said Letters Patent is hereby corrected as shown below:

Column 1, lines 13 and 14, "Japanese Unexamined Patent Publication (KOKAI) No. 3-98,107" should read --Japanese Unexamined Utility Model Publication (KOKAI) No. 3-98,107--.

Signed and Sealed this

Twenty-ninth Day of December, 1998

*Attest:*

*Attesting Officer*

Bruce Lehman

BRUCE LEHMAN

*Commissioner of Patents and Trademarks*